United States Patent [19]

Pillsbury

[11] 4,029,422

[45] June 14, 1977

[54] DISPENSER FOR AIR DRYING LIQUID COATING

[76] Inventor: Edward J. Pillsbury, 377 S. Harrison St., East Orange, N.J. 07018

[22] Filed: June 1, 1976

[21] Appl. No.: 691,528

Related U.S. Application Data

[63] Continuation-in-part of Ser. No. 605,077, Aug. 15, 1975, abandoned.

[52] U.S. Cl. ..... 401/117

[51] Int. Cl.[2] ..... A46B 17/08

[58] Field of Search ..... 401/115, 117, 91, 116

[56] References Cited

UNITED STATES PATENTS

| | | | |
|---|---|---|---|
| 2,630,593 | 3/1953 | Jockers | 401/115 |
| 2,913,750 | 11/1959 | Aversa | 401/115 X |
| 2,996,749 | 8/1961 | Hester | 401/117 |
| 3,016,560 | 1/1962 | Aversa | 401/117 X |
| 3,023,449 | 3/1962 | Aversa | 401/117 |

FOREIGN PATENTS OR APPLICATIONS

| | | | |
|---|---|---|---|
| 503,084 | 12/1954 | Italy | 401/115 |

*Primary Examiner*—Lawrence Charles
*Attorney, Agent, or Firm*—Martha G. Pugh

[57] ABSTRACT

A tubular container, at least partially closed at one end and having a nozzle at the other end, encloses a cylindrical valve head having an applicator brush attached to one end and a valve stem connected to the other end which extends along the axis of the container. When the applicator brush is extended to operating position, one end of the valve head seats against the inside shoulder of the nozzle, preventing liquid from leaking out. In one embodiment, in which the valve head is double-ended, a partition separates a large liquid reservoir at one end of the container from an auxiliary reservoir adjacent the nozzle. When the container is upended, the brush is retracted, engaging a valve seat in the partition, trapping liquid in the auxiliary reservoir. The disclosed embodiments include at least one liquid-pervious guide rigidly fixed inside the container wall and having a circular opening disposed to accommodate the valve stem in free moving axial relation. In a modification, the valve head is single-ended, and the partition is replaced by a second liquid-pervious guide which also accommodates the valve stem in free moving relation. In both types, the applicator may be manually actuated by a plunger which protrudes axially through the end of the container opposite the nozzle. Another feature relates to liquid refilling means.

22 Claims, 22 Drawing Figures

DISPENSER FOR AIR DRYING LIQUID COATING

BACKGROUND OF THE INVENTION

This application is a continuation-in-part of my application Ser. No. 605,077, filed Aug. 15, 1975, now abandoned.

This relates in general to dispensers of air drying coatings of plastic or the like in volatile liquid carriers.

The conventional mechanism for applying nail polish is by means of an applicator brush from a container of liquid. This is cumbersome and wasteful. An improvement was devised, as disclosed in U.S. Pat. No. 2,630,593, which issued to H. W. Jockers on Mar. 10, 1953, in which the applicator brush is mounted on the end of a weighted metal rod enclosed in the container and designed for gravity actuation, moving the applicator brush from retracted to operating position when the nozzle is pointed down. Several problems have arisen in connection with many of the devices of the type described which have tended to make them substantially inoperative, or at least unsaleable. Liquid tends to leak out in larger quantities than necessary for its properly controlled application. Small amounts of coating material may harden on the brush and in the interior of the nozzle, causing the brush to stick in the nozzle, and rendering the brush too inflexible for properly applying the coating. Furthermore, the applicator may be improperly centered during its excursion down through the nozzle, causing it to stick against the internal shoulders of the nozzle and causing leakage around the edges. Moreover, if the applicator does stick, it is difficult and inconvenient to dislodge it, or to control its excursions through the nozzle. Another problem which may arise in conventional dispensers of the type described, is that the air drying liquid is quickly used up or, at least, partly dried up, making it too viscous for proper application. The device must then either be discarded or refilled in a messy operation which involves opening the container and pouring in liquid from another container.

SUMMARY OF THE INVENTION

It is, therefore, a principal object of the invention to provide an improved dispenser of air drying coating material, more particularly of a type which releases a controlled amount of liquid into the applicator brush without messy leakage during operation and/or storage of the device. Another object of the invention is to properly control the to-and-fro excursions of the applicator brush to lock the brush into sealing relation to the inside of the nozzle, and to provide for manual control of the applicator. Another object of the invention is to provide ready refill means for the dispenser.

These and other objects are attained in accordance with the present invention in a dispenser for air drying liquid coating material, more particularly nail polish, comprising a tubular container in which the applicator brush moves from a retracted position inside of the nozzle to operating position in which it extends from the nozzle. The applicator brush is mounted at one end of a cylindrical valve head, to the other end of which is fixed an axially extended valve stem. The annular shoulder of the valve head adjacent the brush is constructed to engage an annular shoulder on the inside of the nozzle, closing and sealing the nozzle against the flow of liquid when the brush is fully extended, and opening to release a controlled amount of liquid when the brush is gently nudged.

One embodiment comprises a gravity operated actuator including a double-ended valve head. In this embodiment, when the container is in upended storage position, with the applicator brush retracted, the other end of the valve head seats, sealing the valve opening in a partition which separates an auxiliary chamber in the nozzle from the principal liquid reservoir at the other end of the container. A salient feature of this invention is a guide having an axial opening which slidably accommodates the extended valve stem, so that the excursion of the applicator brush through the nozzle is precisely controlled. The guide comprises a disk which is press-fit or welded to the inner wall of the container and includes a plurality of peripheral notches for facilitating liquid flow around it.

In a modified form of the dispenser of the present invention, the partition is replaced by another guide substantially identical to that previously described, which is also press-fit or welded to the inner wall of the container. In one embodiment, the elongated valve stem extends through the axial opening in each of the guides.

A feature of the invention which is applicable to all of the embodiments comprises means slidably mounted in the end of the container opposite the nozzle for manipulating the applicator brush. This may take the form of a small plunger for contacting the end of the valve stem and manually forcing the brush through the nozzle or dislodging the brush. In a modification, the valve stem is extended axially, completely through the container, making frictional contact with a tetrafluoroethylene bearing ring in the end wall opposite the nozzle, so that the applicator does not move down into operating position in response to gravity pull, but only under manual pressure. In preferred form, the end of the valve stem opposite the brush is screwed, or otherwise secured, into the end of a cylindrical sheath which fits slidably over the end of the container opposite the nozzle, and which moves to and fro to manipulate the applicator brush. In another modification, the plunger is coaxial with, but longitudinally separated from the end of the valve stem, taking the form of a small tube or shaft interposed through the end of the container opposite the nozzle.

Further features of the invention comprise refill means which may make use of the tube opening through the end of the container. Refill liquid may be furnished from a small plastic cylinder which is closed at one and narrows at the other end to a short dispensing tip having a channel for air, which is adapted for insertion into either the nozzle of the dispenser or an opening at the opposite end.

The structures of the present invention alternatively provide both gravity operated and hand manipulated applicators in which the amount of liquid dispensed when the brush is in extended position is carefully controlled. Moreover, the guide means of the present invention maintain the brush centered so that it does not engage the internal shoulders of the nozzle. Should this occur, the present invention provides a simple means for dislodging the brush and pushing it through the nozzle and for controlling the excursions of the applicator.

A further advantage of the structures of the present invention is that if the liquid is exhausted from the container or becomes too viscous for proper operation, the container need not be discarded, but can be readily and simply refilled without the mess involved of pouring liquid from one bottle into another.

An economic advantage of the invention is that the body of the container can be formed in one piece, without the necessity for a screw-threaded closure.

Although the present invention has been described with reference to a nail polish dispenser, it will be understood that the principles of the present invention have many other applications, such as, for example, to adhesive dispensers or paint dispensers for automobile touch-up.

These and other objects, features and advantages of the invention will be understood from a detailed study of the specification hereinafter with reference to the attached drawings.

DETAILED DESCRIPTION

Figure 1A:
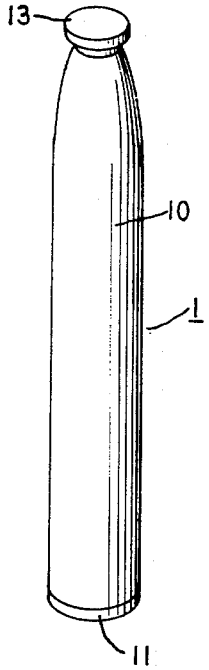
FIG. 1A shows, in perspective, one embodiment of the nail polish dispenser of the present invention, closed for carrying or storage.

Referring in detail to the drawings, FIG. 1A shows a dispenser 1 in accordance with one embodiment of the present invention, closed for storage. Dispenser 1 comprises a one-piece tubular container 10. In the present illustrative embodiment, this is 4.125 inches long, ⅝ inch in outer diameter and ½ inch in inner diameter, except for the last ¾ inch of the nozzle end which tapers to an outer diameter of 5/16 inch and a nozzle bore 12 of ⅛ inch diameter. The nozzle bore 12 extends inward along the axis for about ¼ inch, forming a rounded annular shoulder **12*a* at the internal end of the nozzle. This is clearly shown in the sectional showing of FIG. 2A. In the present embodiment, container 10 is formed of pressure molded polypropylene, although it will be understood that it can alternatively be formed from metal, glass or any other plastic material which cures to a relatively rigid shape and which does not react chemically with the contents, which in the present embodiment is nail polish in a volatile ether-based carrier. Preferably, if the container 10** is of plastic material, it should be painted or otherwise coated with a sealer to help prevent air from seeping in through the pores of the plastic which tends to cause the liquid contents thereof to dry up.

Figure 1B:
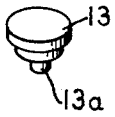
FIG. 1B is a perspective showing of the removable nozzle plug of FIG. 1A.
Figure 1C:
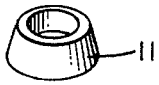
FIG. 1C is a perspective showing of the plug for the other end thereof.

Returning to FIG. 1A, the nozzle is closed for storage or transport by means of a plug 13 (shown in FIG. 1B), the top of which is a flat disk about, say, ⅝ inch in diameter and ⅛ inch thick. This has a protruding axial nub **13*a* just under ⅛ inch in diameter and about ⅛ inch thick which fits into nozzle 12 in air-tight engagement. Alternatively, cap 13 can be formed integrally with a downwardly protruding annular ring which is accommodated in an annular groove in the end of the nozzle, surrounding bore 12. The opposite end of container 10 is sealed air-tight at the time of manufacture by a frustroconical shaped plug 11, shown in FIG. 1C.** The plugs are formed of semirigid resilient plastic, such as, for example, polypropylene, high density polyethylene or tetrafluoroethylene (known by the trademark TEFLON).

Figure 2A:
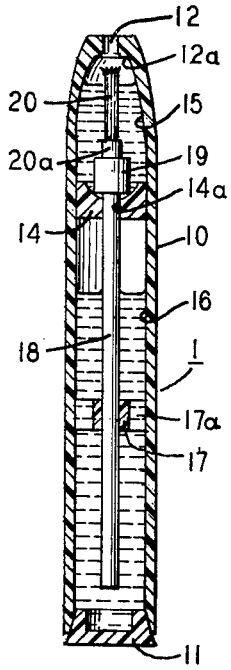
FIG. 2A is a longitudinal diametrical section of the dispenser of FIG. 1A in carrying or storage position, with the nozzle plug removed.
Figure 2B:
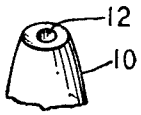
FIG. 2B is a perspective view of a broken away portion of the nozzle section of the dispenser of FIG. 2A.
Figure 2C:
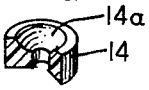
FIG. 2C is a perspective showing of the primary valve seat of FIG. 2A, removed from the container.

The interior of the container 10, as shown in FIG. 2A, includes a partition 14, the upper face of which is located 1.25 inches along the axis from the nozzle end. This includes the valve seat **14*a*. Partition 14, which is press-fit into container 10 during manufacture, may also comprise polypropylene or some other semirigid plastic material, such as high density polyethylene or tetrafluoroethylene, manufactured by E. I. du Pont de Nemours & Co. under the trademark TEFLON. The outer diameter of cylindrical partition 14 is just under ½ inch, so that it fits tightly against the inner wall of container 10. Partition 14** is ¼ inch thick and 5/16 inch in inner diameter at the end directed toward the nozzle. The internal surface is spheroid, narrowing to a ⅛ inch opening which extends ⅛ inch along the axis, forming the valve opening.

Figure 2D:
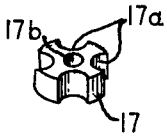
FIG. 2D is a perspective showing of the guide member of FIG. 2A, removed from the container.

Located about 1¼ inches below the lower face of partition 14, as shown in FIG. 2A, is the liquid-pervious guide member 17, shown in FIG. 2D, which is also constructed to be press-fit into container 10 during manufacture. In the present embodiment this is also polypropylene, although it may also be formed of another semirigid plastic such as, for example, high density polyethylene, tetrafluoroethylene (TEFLON), etc. The guide member 17 has an outer diameter just under ½ inch, so that it fits tightly against the inner wall of container 10, has a bore 17*b* with an inner diameter ⅛ inch, and is ⅛ inch thick. It includes, in the present embodiment, four semicircular externally disposed notches 17*a*, each about ⅛ inch in diameter which extend through the thickness.

Disposed for to-and-fro motion along the axis of container 10 is the double-ended valve member 19 comprising a cylinder ¼ inch in outer diameter and ¼ inch thick, which may be of steel, or other metal, glass, or rigid plastic, mounted in axial relation to the upper end of which is a small collar 20*a*, also of plastic or of glass, ⅛ inch in inner diameter and about 3/16 inch long, holding brush 20, which in the present instance is ⅜ inch long and about 3/32 inch wide (see FIG. 2A).

A valve stem 18, which may be, for example, a steel rod, is 3 inches long and ⅛ inch in outer diameter. Stem 18 is rigidly mounted in axial relation to the face of valve member 19 opposite the brush 20. It will be understood that stem 18 and coaxial cylindrical valve member 19 can be formed of other materials in addition to steel. For example, the integral structure 18-19 can be die cast from a zinc alloy known as "pot metal" or from any other metal that does not react with the liquid contents of the container. Alternatively, the integral combination 18-19 can be formed from glass or rigid molded plastic. Stem 18 projects slidably through the valve seat 14*a* and through the central opening 17*b* in the guide means 17.

Figure 3:
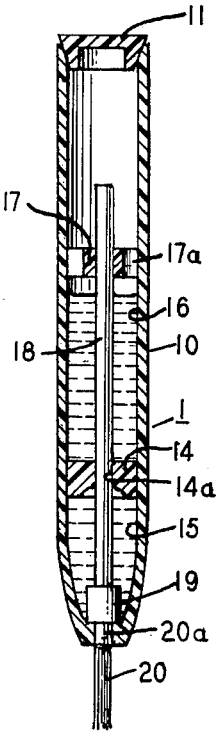
FIG. 3 shows the dispenser of FIGS. 1A and 2A in operating position.

When the dispenser l is stood on its flat end, with the nozzle end up, as shown in FIG. 2A, the lower end of valve head 19 rests on valve seat 14*a*, thereby trapping a sufficient amount of liquid in the auxiliary chamber 15 to cover the brush 20 and keep it moist during storage. When the container 10 is upended, as shown in FIG. 3, the valve head 19 then moves down a distance of about one inch, causing the brush 20 to move through the nozzle 12 and protrude therefrom in operating position, in which position the brush end of valve head 19 seats against the inside shoulder 12*a* of the nozzle 12, so that no liquid can leak out. When the user desires additional liquid on the brush, she gently pushes the end of the brush, dislodging the valve head 19 from the shoulder 12*a*, allowing a controlled amount of liquid to leak onto the brush.

An important feature of the present invention is that the guide member 17 maintains the end of the valve stem 18 in an axial position at all times, so that the brush 20 is guided through the nozzle 12 without substantial contact with the shoulder 12*a;* and, in operating position, the valve head 19 is properly seated on the shoulder 12*a*, so that no leaks occur around the edges.

Figure 4A:
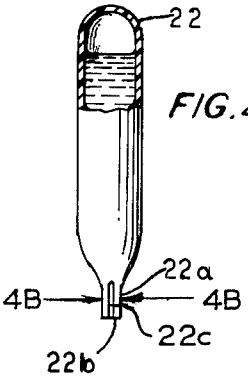
FIG. 4A is a partial perspective showing of a refill mechanism for the dispenser shown in the previous figures.
Figure 4B:
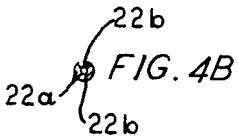
FIG. 4B is a section of the stem of FIG. 4A through the plane indicated by the arrows 4B—4B.
Figure 4C:
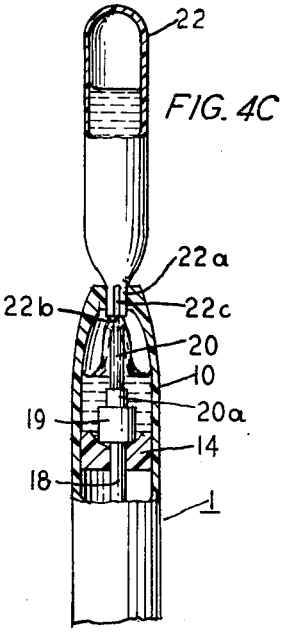
FIG. 4C shows the refill mechanism of FIG. 4A in operating position in the nozzle of FIG. 2A, shown in broken away section.

When it is necessary to refill the container 10 with liquid, a refill device, as shown in FIGS. 4A, 4B and 4C, is provided. This comprises a tube 22 of resilient plastic material having an outer diameter of 7/16 inch and a wall thickness of, say, 1/32 inch. The tube 22 is rounded at the upper end and extends 1½ inches along the axis to about ¼ inch from the end where it is tapered to an axially centered dispensing tip 22*a*. The latter is ⅛ inch in outer diameter and about 1/16 inch in inner diameter, and extends ⅛ inch along the axis. Dispensing tip 22*a* has at one place in its periphery a longitudinal notch 22*b*, the cross-sectional shape being shown more clearly in FIG. 4B.

In operation, the refill device 22 is applied in the manner shown in FIG. 4C, by interposing the dispensing tip 22*a* into the nozzle 12 of the container 10. A desired amount of replacement fluid is then pumped in through the nozzle by flexing the walls of the device 22 between the thumb and finger.

Figure 5A:
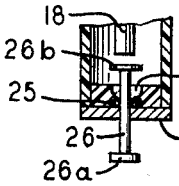
FIG. 5A is a fragmentary longitudinal sectional showing of a modification of the dispenser of FIGS. 1A–3, including a finger actuated plunger adapted to contact and move the valve stem towards the nozzle end of the container.
Figure 5B:
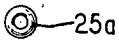
FIG. 5B is a plan view showing of the o-ring 25 of FIG. 5A.
Figure 2E:
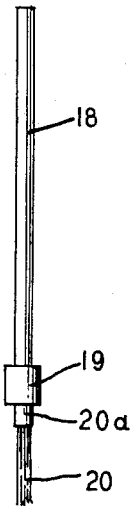
FIG. 2E is a perspective showing of the valve head, including the valve stem and brush of FIG. 2A, removed from the container.

Another modification of the invention is shown in FIG. 5A of the drawings, which is a fragmentary sectional showing of the lower portion corresponding to FIG. 2A. In accordance with this modification, a small opening is bored through the bottom of the plug 11′. The inwardly directed opening 11*a* in the plug 11′ has a cylindrical portion at its lower end, as shown in the drawing. Into this space is interposed a small o-ring 25, formed of semirigid resilient plastic, such as, for example, polypropylene, high density polyethylene or tetrafluoroethylene (TEFLON), having an inner diameter of ⅛ inch and a maximum wall thickness of 1/16 inch of circular cross-section. This acts as a bearing for a short auxiliary shaft 26, say ¾ inch long and approximately ⅛ inch in diameter, which has at its outer end a rounded contact button 26*a* and has at its inner end a small plastic washer 26*b*, having an outer diameter of, say, ⅜ inch. The short shaft 26, which may be solid or tubular, moves slidably in an axial direction against the internal periphery of o-ring 25, so that at times when, for example, the valve head 19 may stick, the user given a gentle nudge to the button 26*a*, which force is transferred to 26*b* and to the end of the stem 18, causing the valve head 19 to unseat from 14*a* and force the brush 20 towards the nozzle 12.

Figure 6A:
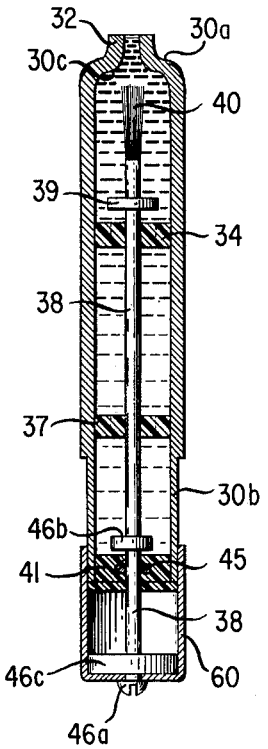
FIG. 6A shows in longitudinal section an alternative embodiment of the dispenser shown in FIGS. 2A and 3, in storage position, including finger-actuated means for controlling the applicator brush, the top and container being modified in form.
Figure 6E:
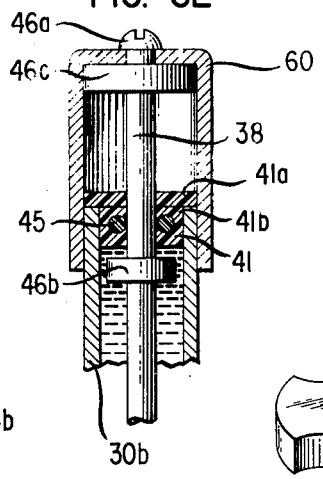
FIG. 6E is an enlarged showing of the brush manipulating end of the dispenser of FIG. 6A.
Figure 6B:
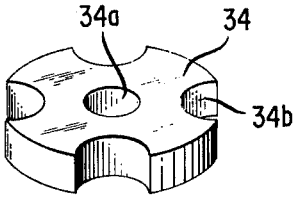
FIGS. 6B and 6C are perspective showings of perforated guides for the applicator brush stem, removed from the container of FIG. 6A.
Figure 6C:
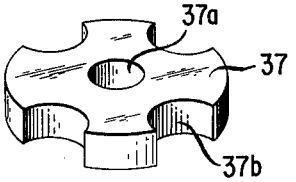
Figure 6F:
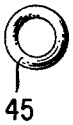
FIG. 6F shows, in detail, the o-ring of FIGS. 6A et seq.

Referring to FIG. 6A, there is shown a modified embodiment of the dispenser of the present invention in which the liquid-tight partition 14 of FIG. 2A is replaced by a liquid-pervious guide member 34. The embodiment under description also incorporates a plunger arrangement similar to that disclosed in FIG. 5A, except that the applicator shaft is integrated with the plunger.

In the present illustrative example, the tubular container 30 may be formed of stainless steel. However, it may also be formed of other metals, such as aluminum, or even of precious metals, such as silver or gold. Alternatively, it may be formed of glass or any one of a number of rigid plastic materials, such as, for example, pressure molded polypropylene, which may be either transparent or opaque, or any other plastic material which cures to a relatively rigid shape, the only requirement being that it does not substantially change its form with changes in the ambient temperature or pressure, nor react chemically with the liquid contents, which may be nail polish, comprising, for example, a cellulose base compound in a volatile ether-based carrier.

For the purposes of this description, the aluminum container 30 of the present embodiment is cylindrical, ⅝ inch in outer diameter, terminatin in a shoulder 30*a* at the end adjacent nozzle 32. Shoulder 30*a* is tapered back to the base of nozzle 32, which is 5/16 inch across the base and protrudes ⅜ inch beyond shoulder 30*a*. The nozzle 32 is frustroconical, terminating in an opening 3/16 inch in outer diameter and ⅛ inch in inner diameter, forming a cylindrical opening which extends ⅜ inch along the axis of the container. Protective hollow cap 43, which may be of generally cylindrical form, closed at one end, is ¾ inch long, slightly exceeding 5/16 inch in inner diameter and shaped internally to provide a recessed annular shoulder which seats on the end of the nozzle 32 when the cap is closed, preventing leakage. (See FIG. 8.) Preferably, cap 43, which may be of any well-known semirigid plastic material, has a thin enough wall so as to be slightly resilient. The cap 43 is hollowed out to receive and protect the applicator brush 40 so that the latter is not bent if projected through nozzle 32 while the cap is in place.

For an axial distance extending about 1⅞ inches back from shoulder 30*b*, container 30 has an outer diameter of ⅝ inch. Beyond this plane, the outer wall thickness is reduced by 1/64 inch to an outer diameter of 19/32 inch. The reduced diameter portion 30*b* of container 30, which extends 1⅛ inches in an axial direction to the end opposite from nozzle 32, slidably accommodates a cover 60, of aluminum in the embodiment under description, which is 1½ inches in axial length, ⅝ inch in outer diameter and just exceeding 19/32 inch in inner diameter. The end of cylindrical cover 60 is closed except for an axially disposed opening ⅛ inch in diameter, which accommodates a shaft or a tube, as will be described. It will be understood that the cover 60 may also be formed of other materials, such as a semirigid plastic material, of which polypropylene and nylon are examples.

In the embodiment under description, as shown in FIG. 6A, the container 30 is 0.5 inch in inner diameter, being of substantially uniform diameter along the length to the nozzle end, where the internal annular shoulder 30*c* surrounds the ⅛ inch internal bore of nozzle 32.

Figure 6D:
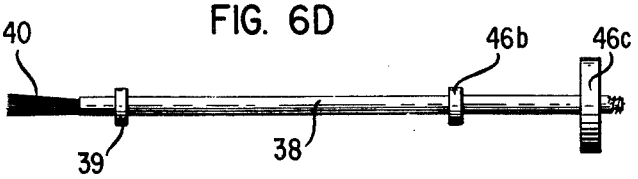
FIG. 6D shows the applicator brush assembly removed from the container of FIG. 6A.

The brush 40, which may be a conventional type comprising, for example, a bundle of nylon bristles ½ inch long and, say, 3/32 inch in diameter, is sealed into a small mounting collar of glass, metal or plastic, which is pinched together and rigidly mounted in the end of a tube of glass, metal, or plastic such as nylon or other suitable rigid plastic material. In the present embodiment, tube 38 has an outer diameter of ⅛ inch and an inner diameter of 3/32 inch. In the embodiment under description, the glass tube 38 is 3⅛ inches long. It will be understood that a solid shaft of, for example, glass or stainless steel, or other suitable metal, can be substituted for the tube 38. FIG. 6D shows the brush assembly, including stem 38. Mounted axially on the stem 38, about ⅝ inch from the inner end of the brush 40, or about one inch from its outer end, is an annular disk 39 which may be of polypropylene, or other rigid plastic material, or of glass, which is ¼ inch in outer diameter, ⅛ inch in inner diameter and, say, 1/32 inch thick, being press-fit onto the shaft. Optionally, a second similar disk 46*b*, ⅛ inch thick, is fixed to shaft 38 about 1½ inches from the opposite end from brush 40.

A circular guide member 34 of, for example, polypropylene or other rigid plastic, such as nylon, or of glass, which is ½ inch in diameter and, say, 3/32 inch thick, is force-fit into container 30 with its outer surface ⅞ inch along the axis from the internal nozzle shoulder 30*b*. This has an axial opening 34*a* which is 5/32 inch in diameter, so that it loosely accommodates shaft 38. Disk 34 also has four symmetrically spaced openings 34*b* which may be, for example, semicircular peripheral cutouts, each having a diameter of, for example, ⅛ inch. The openings 34*b* may have different sizes and shapes, their principal function being to allow the liquid to flow freely through. It is contemplated that the more viscous the liquid in container 30, the larger will be the openings 34*b*. Located ⅝ inch from the inner face of 34*b* may be a second substantially identical guide member 37*b*, having an axial opening 37*a*, and peripheral openings 37*b*. Guide members 34 and 37 may be bonded or welded, for example by sonic means, to the inside wall of container 30 or alternatively, frictionally force-fit. In a further alternative, a single guide member can be substituted for the two guides 34 and 37 of FIGS. 6A, 7 and 8.

Force-fit at the opposite end of container 30 from the nozzle 32 is a cylindrical plug 41, comprising an outer disk 44*a* which is ⅝ inch in diameter and 3/16 inch thick, having an integral inwardly protruding cylindrical portion 41*b* which is ½ inch in diameter and ¼ inch in an axial direction. This has a central ⅛ inch bore. Plug 41 is preferably of plastic, such as polypropylene, nylon, or tetrafluoroethylene manufactured by E. I. du Pont de Nemours & Co. under the trademark TEFLON. Embedded internally in the bore of 41*b*, about ⅛inch inside of its inner face, is a bearing ring 45, also of TEFLON, which has an inner bore about 3/32 inch in diameter, just large enough to accommodate applicator brush stem 38 in frictionally slidable relation. This provides a liquid-tight seal between stem 38 and the bore 41*b*, or bearing ring 45, to prevent leakage of the nail polish or other liquid from the dispenser.

When the dispenser is assembled, as shown in FIG. 6A, the applicator stem 38 is threaded through the central openings of guide members 34 and 37 so that, in storage position, valve head disk 39 is out of contact with valve seat surface 30*c* and is preferably adjacent the outer face of guide member 34. In this position, disk 46*b*, which may or may not be part of the combination, is disposed adjacent the inner surface of plug 41. The end of applicator stem 38 is passed axially through plug 41 in slidable contact with TEFLON ring 45, protruding from the outer end. A disk 46*c*, which may be, for example of polypropylene or other rigid plastic, 3/32 inch thick, is force-fit into the inner end of cap 60. Stem 38 passes through the center of disk 46*c*, which is fixed a short distance from the screw-threaded end, the latter being fastened on the outside of cap 60 by a conventional nut 46*a*.

An important feature of this invention is the frictional relationship between bearing ring 45 and the material of the shaft 38; and, also, between the cover 60 and the walls of container 30, which together must be such that the applicator assembly 38–40 does not move down in an axial direction in response to gravitational force alone, but only in response to sufficient finger pressure on the end of the rod or tube 38. The finger pressure is transmitted to shaft 38 by depressing the button 46*a* or the end of the cap 60. When added to the normal gravitational pull, normal finger pressure is sufficient to overcome the frictional force exerted between the cover 60 and container walls 30; together with the frictional force between the shaft 38 and the axial bore of 41, and, more particularly, the TEFLON ring 45.

Figure 7:
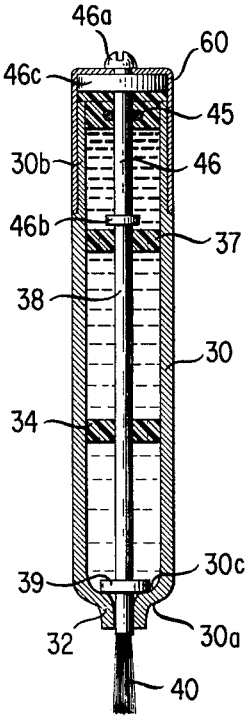
FIG. 7 shows the dispenser of FIG. 6A with the shaft depressed to force the applicator brush into operated position.

Preferably, to operate the dispenser, the container 30 is placed in an upright position, as shown in FIG. 7; and the cap 60 is pressed down until it engages the end of the tube 30. This forces the liquid soaked brush 40 to emerge from the end of the nozzle 32 simultaneously as the disk-shaped valve head 39 seats on valve seat 30*c*, preventing additional liquid from dripping out.

Figure 8:
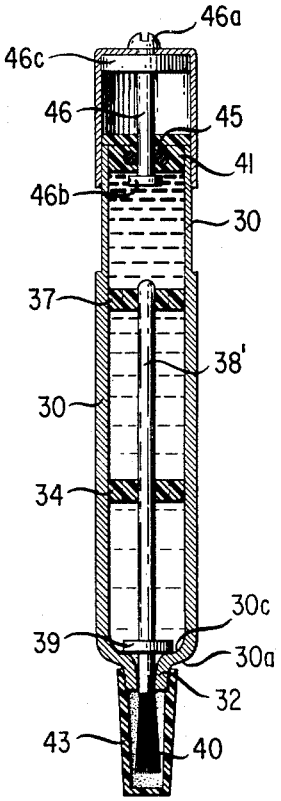
FIG. 8 shows, in longitudinal section, a modification of the dispenser of FIG. 6A in which the plunger shaft is coaxial with but longitudinally separated from the stem of applicator brush. A typical cap is included.

FIG. 8 shows an alternative to the combination disclosed in FIGS. 6A and 7, in which the single long applicator stem or tube 38 is replaced by a substantially shorter applicator stem 38′, the latter, including the brush 40 at its end, being about 2½ inches long. When positioned in the tubular container 30, the stem 38′, which is 3/32 inch in outer diameter, extends just through the second guide member 37, when the brush is in extended position. The guides 34 and 37 are substantially the same as their counterparts in FIGS. 6A and 7.

A plunger 46, preferably of the same outer diameter and composition as 38′, is slidably mounted in an axial opening at the end of cap 60 in the manner described with reference to FIGS. 6A and 7. It is rigidly fastened at one end by means of the cap or nut 46*a*, the other end passing slidably through the plug 41 and bearing frictionally on the TEFLON ring 45 in the manner of the embodiment previously described with reference to FIGS. 6A and 7. A disk 46*b* is rigidly fastened on the inner end of plunger 46. When the cap 60 is depressed, the disk 46*b* bears on the end of the valve stem 38′, pushing it downward and causing the brush 40 to emerge from the end in extended position. When cap 43 is removed, brush 40 is in operating position. At the same time, valve head 39 seats at the inner end of nozzle 32, as in the previously described embodiment.

This embodiment has an advantage in that the plunger 46 can be retracted, as shown in FIG. 8, permitting the applicator assembly 38′-40 to freely move up and down to release additional fluid.

It will be understood that the valve stems 38 and 38′ and plunger stem 46 can comprise a shaft or tube of metal, glass, or plastic, such as nylon or a similar suitable plastic.

In the case where plunger 46 is in the form of a tube, it can be used for the purpose of refilling container 30 with liquid by simply removing screw cap 46*a*.

Another modification of either of the guide means 34, 37 is to form the peripheral indentations 34*b* so that they are disposed in an asymmetric manner about the central opening 34*a*. This causes a rotation of the fluid, thereby mixing it when the container is inverted in either direction.

The present invention is not limited to the specific forms or components shown by way of example, but is only limited by the scope of the appended claims.

What is claimed is:

1. A dispenser for air drying liquid coating material comprising in combination:

a tubular liquid container substantially closed at one end and terminating at the other end in a nozzle having an inner bore, a longitudinal valve stem mounted for to-and-fro movement along the axis of said tubular liquid container, said stem terminating at one end in a valve head disposed adjacent the inner bore of said nozzle and including an applicator brush protruding in axial relation from said valve head, the combination including said valve head and stem constructed to move between:

a first storage position in which the assembly including said valve stem, said valve head and said applicator brush is in retracted position with respect to said nozzle bore; and a second operating position wherein the assembly including said valve stem and said valve head is extended to engage and close the inner bore of said nozzle forcing said applicator brush to protrude through said nozzle, and guide means substantially spaced apart from the inner bore of said nozzle and disposed in fixed relation to the inner walls of said liquid container, said guide means including a disk-like member having a plurality of peripheral slots for the free flow of liquid therethrough and comprising an axially disposed opening large enough to accommodate said valve stem in freely movable relation, whereby said guide means functions to maintain said valve head and applicator brush centered with relation to the inner bore of said nozzle.

2. The combination in accordance with claim 1 including means comprising a plunger stem substantially coaxially aligned with said valve stem, said plunger stem being mounted in bearing means in the end of said container opposite said nozzle for slidable motion in an axial direction, said plunger stem being constructed to impel said valve stem including said valve head along the axis of said dispenser in the direction of said nozzle, and said plunger stem including means coupled to its outer end responsive to manual actuation to move said plunger stem.

3. The combination in accordance with claim 2 wherein said plunger stem includes means in slidable frictional engagement with portions of said container including said bearing means, and wherein the force of sliding friction exerted between the means including said plunger stem and the portions of said container including said bearing means at least exceeds the force of gravity when said container is disposed with the nozzle in downwardly directed position.

4. The combination in accordance with claim 3 wherein the means in slidable frictional engagement with portions of said container includes a cylindrical sheath disposed to make slidable contact with the side wall of said container adjacent the end opposite said nozzle end, and wherein the aggregate of the force of slidable friction exerted between said cylindrical sheath and said side wall and between said plunger stem and said bearing at least exceeds the force of gravity when said container is disposed with the nozzle in downwardly directed position.

5. The combination in accordance with claim 3 wherein said bearing means comprises a ring of tetrafluoroethylene.

6. The combination in accordance with claim 2 in which said plunger stem is integral with said valve stem, forming a continuation of said valve stem along the axis of said container.

7. The combination in accordance with claim 4 in which said plunger stem is integral with said valve stem, forming a continuation of said valve stem along the axis of said container.

8. The combination in accordance with claim 2 in which the plunger stem and the valve stem are separate entities, said plunger terminating at its inner end in means comprising a contacting surface constructed to contact the end of said valve stem and to impel said valve stem including said valve head forward substantially along the axis of said dispenser in the direction of said nozzle.

9. The combination in accordance with claim 8 wherein said plunger stem comprises a tube the end of which protrudes from the end of said container opposite said nozzle, and means comprising a closure for sealing the end of said tube.

10. The combination in accordance with claim 1 comprising:

a partition disposed with its principal plane transverse to the axis of said container for separating said container into two compartments comprising a smaller auxiliary liquid chamber adjacent said nozzle and a larger liquid storage chamber in the remaining portion of said container, said partition having an axially disposed valve opening, said longitudinal stem being mounted in said valve opening for to-and-fro movement along the axis between said larger liquid storage chamber and said smaller auxiliary liquid chamber, said valve head being double-ended, wherein in said first storage position with said nozzle upended one end of said valve head engages and closes the valve opening of said partition between said smaller auxiliary liquid chamber and said larger liquid storage chamber trapping liquid in said auxiliary chamber while said brush is in retracted position with respect to said nozzle bore, and wherein in said second operating position when the assembly including said valve head is extended the other end of said valve head closes the inner bore of said nozzle as the one end of said valve head opens the valve opening in said partition.

11. The combination in accordance with claim 10 wherein said valve head comprises a cylinder disposed at the terminal end of said valve stem and formed in integral coaxial relation therewith.

12. The combination in accordance with claim 10 wherein the inner surface of the valve seat of said partition is a semispheroid hollowed out in the direction of said auxiliary chamber, said spheroid narrowed at its nadir to an opening of slightly smaller diameter than the diameter of the adjacent end of said valve head, the end of said valve head adjacent said opening constructed to form a liquid-tight closure with said opening when the assembly including said valve stem, said valve head and said applicator brush is in retracted storage position.

13. The combination in accordance with claim 10 wherein said nozzle opening, said valve opening and the axially disposed opening of said guide means are all substantially coaxially aligned.

14. The combination in accordance with claim 1 comprising tubular refill means closed at one end and narrowing at the other end to an axially disposed refill tip having an open end, said refill tip constructed to engage and fit into the nozzle of said dispenser.

15. The combination in accordance with claim 14 wherein said tubular refill means comprises a tube having flexible side walls, said tube being at least partially filled with replacement liquid for said dispenser, and said refill tip comprising a longitudinal lateral notch parallel to the axis thereof for dispelling air from said dispenser during the refilling operation.

16. The combination in accordance with claim 9 comprising tubular refill means closed at one end and narrowing at the other end to an axially disposed refill tip having an open end, said refill tip constructed to engage and fit into the tube comprising said plunger stem.

17. The combination in accordance with claim 1 wherein said guide means comprises a plurality of disk-like members disposed in spaced-apart relation along the axis of said container and fixed to the inner wall of said container, said disk-like members each including a plurality of peripheral slots for the free flow of liquid therethrough and each of said guides including an axially disposed opening large enough to accommodate said valve stem in freely movable relation.

18. A dispenser for air drying liquid coating material comprising in combination:

a tubular liquid container substantially closed at one end and terminating at the other end in a nozzle having an inner bore, a longitudinal valve stem mounted for to-and-fro movement along the axis of said container, said stem terminating at one end in a valve head adjacent the inner bore of said nozzle and including an applicator brush protruding in axial relation from said valve head, said valve stem disposed at its other end to pass in slidable relation through a seal in the substantially closed end of said container which is impervious to said liquid coating material, a first storage position in which the assembly including said valve stem, said valve head and said applicator brush is in retracted position with respect to said nozzle bore, a second operating position wherein the assembly including said valve stem and said valve head is extended to engage and close the inner bore of said nozzle forcing said applicator brush to protrude through said nozzle, and means at said other end of said valve stem to manipulate the assembly including said valve stem from said first storage position to said second operating position.

19. A dispenser in accordance with claim 18 wherein the other said end of said valve stem is connected to a cylindrical sheath constructed to fit over and engage the side wall of said container near the end opposite the nozzle for to-and-fro motion in an axial direction when said valve stem is moved from said first storage position to said second operating position.

20. A dispenser in accordance with claim 19 wherein the aggregate frictional force exerted between said valve stem and said seal, and between said sheath and the side wall of said container at least exceeds the force of gravity when said dispenser is disposed in said second operating position.

21. A dispenser in accordance with claim 19 wherein the tubular wall of said container is essentially of glass, said sheath is essentially of nylon, said stem is essentially of glass, and said seal comprises a ring of tetrafluoroethylene.

22. A dispenser in accordance with claim 18 which includes a guide comprising a disk-like member spaced apart from the inner bore of said nozzle and disposed in fixed relation to the inner walls of said liquid container, said disk-like member including a plurality of peripheral slots for the free flow of liquid therethrough and comprising an axially disposed opening large engough to accommodate said valve stem in freely movable relation, whereby said guide means functions to maintain said valve head and said applicator brush centered in relation to the inner bore of said nozzle.

* * * * *

UNITED STATES PATENT AND TRADEMARK OFFICE

CERTIFICATE OF CORRECTION

PATENT NO. : 4,029,422

DATED : June 14, 1977

INVENTOR(S) : Edward J. Pillsbury

It is certified that error appears in the above-identified patent and that said Letters Patent are hereby corrected as shown below:

Column 2, line 51, after "one" and before "and" insert --end--. Column 4, line 7, after "of" and before "applicator" insert --the--. Column 6, line 60, change "terminatin" to --terminating--. Column 8, line 13, change "44a" to --41a--. Column 12, line 6, change "wall" to --walls--, line 63, change "engough" to --enough--.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*